US012331481B2

(12) United States Patent
Smith et al.

(10) Patent No.: US 12,331,481 B2
(45) Date of Patent: Jun. 17, 2025

(54) WORKING MACHINE

(71) Applicant: J. C. Bamford Excavators Limited, Uttoxeter (GB)

(72) Inventors: Duncan Andrew Smith, Uttoxeter (GB); Nigel Young, Uttoxeter (GB); David Price, Uttoxeter (GB)

(73) Assignee: J. C. Bamford Excavators Limited, Uttoxeter (GB)

( * ) Notice: Subject to any disclaimer, the term of this patent is extended or adjusted under 35 U.S.C. 154(b) by 235 days.

(21) Appl. No.: 17/980,540

(22) Filed: Nov. 3, 2022

(65) Prior Publication Data

US 2023/0183941 A1 Jun. 15, 2023

(30) Foreign Application Priority Data

Nov. 3, 2021 (GB) ..... 2115761

(51) Int. Cl.

| | |
|---|---|
| ***E02F 9/08*** | (2006.01) |
| ***E02F 3/32*** | (2006.01) |
| ***E02F 9/12*** | (2006.01) |
| ***E02F 9/16*** | (2006.01) |

(52) U.S. Cl.

CPC ..... *E02F 9/0883* (2013.01); *E02F 3/325* (2013.01); *E02F 9/121* (2013.01); *E02F 9/16* (2013.01)

(58) Field of Classification Search

None

See application file for complete search history.

(56) References Cited

U.S. PATENT DOCUMENTS

| | | | | |
|---|---|---|---|---|
| 6,554,152 | B2 * | 4/2003 | Smith | F17C 13/123 220/560.01 |
| 2003/0150138 | A1 | 8/2003 | Akahane et al. | |
| 2009/0101657 | A1 | 4/2009 | Matsumoto | |
| 2010/0258364 | A1 | 10/2010 | Bolz et al. | |

FOREIGN PATENT DOCUMENTS

| | | | |
|---|---|---|---|
| CN | 206579471 | U * | 10/2017 |
| GB | 1 104 925 | A | 3/1968 |
| JP | H09287169 | A | 11/1997 |
| WO | WO-2008/136148 | A1 | 11/2008 |
| WO | WO-2014/157808 | A1 | 10/2014 |

OTHER PUBLICATIONS

Extended European Search Report issued in EP 22202802.9, dated Feb. 9, 2023.

Search Report issued in GB 2115761.5, dated Apr. 29, 2022.

* cited by examiner

*Primary Examiner* — Michael S Lowe

(74) *Attorney, Agent, or Firm* — MARSHALL, GERSTEIN & BORUN LLP

(57) ABSTRACT

A working machine includes either front and rear wheels or a pair of endless tracks supporting an undercarriage, a drive arrangement including a prime mover configured to provide motive power to propel the working machine, a superstructure connected to the undercarriage via a rotary connector, and a working arm connected to the superstructure. The machine also includes a fuel tank assembly comprising at least one fuel tank defining an internal volume for storing fuel to be supplied to the prime mover, wherein the at least one fuel tank is interposed between the superstructure and the undercarriage.

16 Claims, 4 Drawing Sheets

WORKING MACHINE

FIELD

The present teachings relate to a working machine.

BACKGROUND

Off-highway vehicles or working machines are for example those used in construction industries configured to transport loads over a surface (e.g. backhoe loaders, slew excavators, telescopic handlers, forklifts, skid-steer loaders. One such working machine is a telescopic handler, often referred to as telehandlers or rotating telehandlers, are that are typically used to lift, move and place material or cargo. These working machines typically have a working arm pivotally mounted to the body of the machine, and a working implement, such as a bucket or a grabber, attached to the end of the arm via a coupling device. Attachment of the working implement enables the working machine to perform a variety of tasks on a work site.

Often, working machines are provided with a rotatable superstructure, and in order to improve the maneuverability of the working machine, it is desirable for the footprint of the superstructure to be minimized relative to the footprint of the wheels or tracks. Moreover, the volume of fuel that is able to be stored in the fuel tank may also be impacted, when there is a need to minimize the tail swing of the superstructure.

The present teachings seek to overcome or at least mitigate one or more problems associated with the prior art.

SUMMARY

A first aspect of the teachings provides a working machine comprising: a ground engaging structure provided in the form of front and rear wheels or a pair of endless tracks; an undercarriage supported on the ground engaging structure; a drive arrangement configured to provide motive power to the ground engaging structure to propel the working machine, the drive arrangement comprising a prime mover; a superstructure connected to the undercarriage; a rotary connector connecting the superstructure to the undercarriage and configured to permit rotation of the superstructure relative to the undercarriage about a rotational axis; a working arm connected to the superstructure; and a fuel tank assembly comprising at least one fuel tank defining an internal volume for storing fuel to be supplied to the prime mover, wherein the at least one fuel tank is interposed between the superstructure and the undercarriage.

The arrangement of the fuel tank assembly is advantageous because of its compact nature.

The superstructure may comprise a structural platform mounted on the rotary connector, and wherein the at least one fuel tank may not project beyond the footprint of the platform.

Advantageously, this provides a compact packaging of the fuel tank, which minimizes the impact on operator visibility and minimizes the amount of machine overhang.

The at least one fuel tank may be configured or arranged so as to be positioned around the rotational axis.

The arrangement of the fuel tank assembly is advantageous because of its compact nature.

The at least one fuel tank may be non-linear such that the at least one fuel tank at least partially extends around the rotational axis.

This enables only a single fuel tank to be used to extend around the rotational axis, which is advantageous because of its compact nature.

The fuel tank may be curved so as to at least partially curve around the rotational axis.

Providing a curved fuel tank has been found to provide a more even distribution of pressure, when the fuel tank is loaded with pressurized fuel.

The fuel tank may be substantially C-shaped or substantially circular.

Fuel tanks of these shapes have been found to increase the internal volume of the fuel tank, whilst maintaining that the fuel tank is within the footprint of the superstructure.

The at least one fuel tank may define a profile in cross-section that is continuously curved.

Providing a fuel tank with a cross-sectional profile that is continuously curved has been found to provide a more even distribution of pressure, when the fuel tank is loaded with pressurized fuel.

The profile may be substantially circular.

Providing a fuel tank with a cross-sectional profile that is substantially circular has been found to further provide a more even distribution of pressure, when the fuel tank is loaded with pressurized fuel.

The at least one fuel tank may comprise a tank body formed in one-piece.

Providing a fuel tank that is formed as a single piece enables the fuel tank body to be formed as a unitary surface (i.e. so as to be devoid of welds/joins). This arrangement of fuel tank removes welds/joins that might weaken the fuel tank body, and so enables the fuel tank to store higher pressure fuel.

The fuel tank body may be a blow molded metal tank body.

The at least one fuel tank may comprise a reinforcing cover.

The reinforcing over may comprise a fiber reinforced material, e.g. carbon fiber material.

The at least one fuel tank may comprise a curved fuel tank that at least partially curves around the rotational axis. The curved fuel tank may be positioned within a reinforcing bracket of the fuel tank assembly that is configured to conform to an outer surface of the curved fuel tank.

The curved fuel tank may define at least a part of a circle, and the reinforcing bracket is substantially circular.

The curved fuel tank may be secured to the reinforcing bracket via one or more attachment members, e.g. straps and/or clamps.

The rotary connector between the superstructure and the undercarriage may comprise a rotary joint arrangement configured to permit electrical signals, fuel and/or hydraulic fluid to be routed between the superstructure and the undercarriage independently of the position of the superstructure relative to the undercarriage.

The fuel tank assembly may define an opening therethrough to permit electrical signals, and/or hydraulic fluid to be routed therethrough.

The fuel tank assembly may be configured and arranged to surround the rotational axis.

The at least one fuel tank may be configured for storing hydrogen, metal hydrides, liquid fuel, alcohol, gas, petrol or diesel.

The working machine may comprise an operator's cab rotatably mounted on the superstructure.

The rotational axis may define a first generally upright axis and the operator's cab is rotatable about a second generally upright axis.

The at least one fuel tank may be at least partially interposed between the undercarriage and the operator cab.

The working machine may comprise a counterweight provided on the superstructure, the counterweight having a mass for counterbalancing the working arm.

The working machine may comprise a first implement mount connected the undercarriage for operably mounting a working implement to the undercarriage.

The working machine may be a compact tail swing excavator or a zero tail swing excavator.

The undercarriage may comprise a first actuator for raising and lowering a working implement when mounted to the first implement mount.

The fuel tank assembly may be mounted to an upper region of the undercarriage such that the fuel tank assembly is rotationally fixed to the undercarriage.

The fuel tank assembly may be mounted to a lower region of the superstructure such that the fuel tank assembly is rotatable relative to the undercarriage.

BRIEF DESCRIPTION OF THE DRAWINGS

Embodiments will now be described with reference to the accompanying drawings, in which.

DETAILED DESCRIPTION

Figure 1:
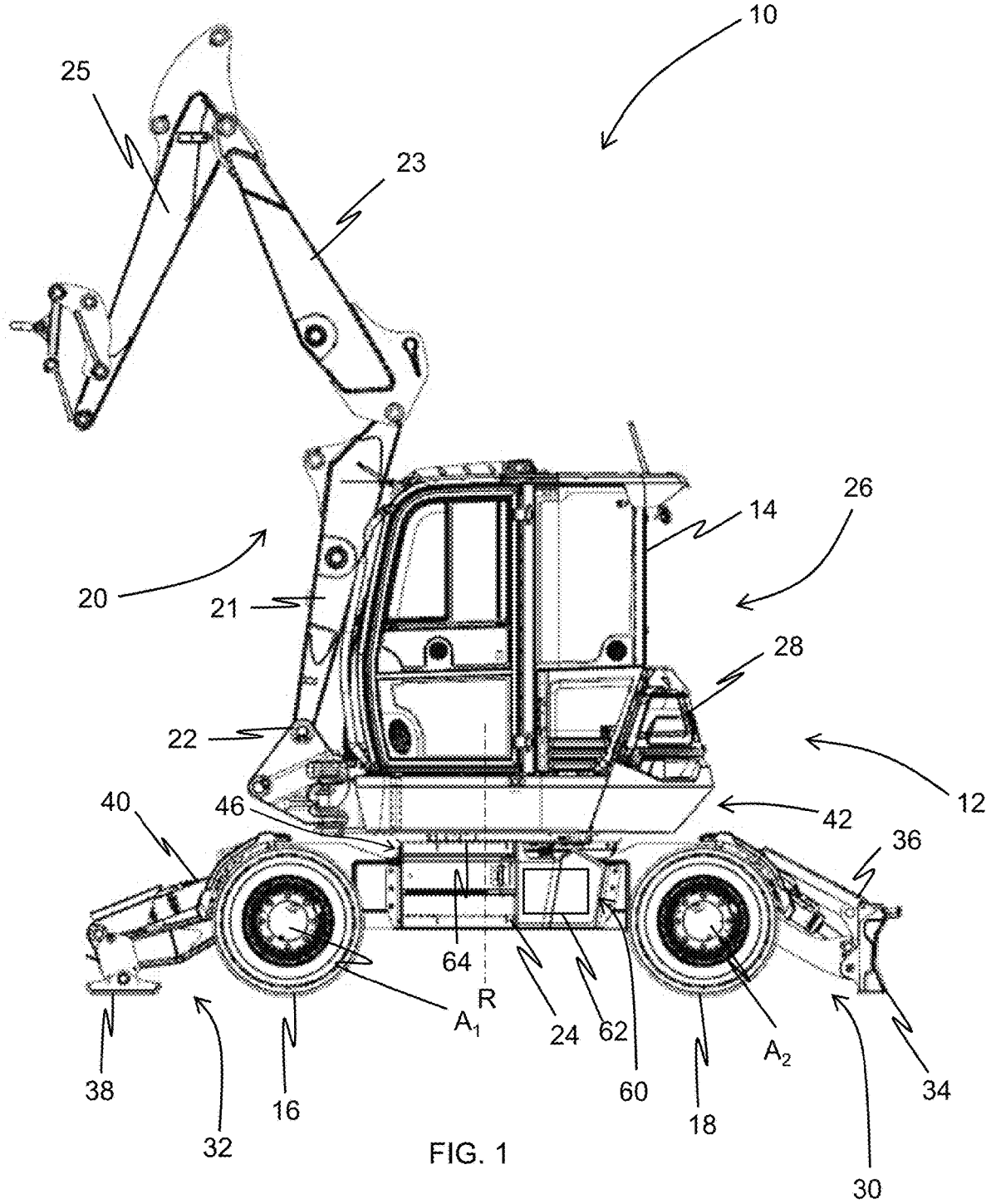
FIG. 1 is a side view of a working machine according to an embodiment.

Referring firstly to FIG. 1, an embodiment of the teachings includes a working machine 10. The working machine may be an excavator. The working machine may be a compact tail swing excavator or a zero tail swing excavator. In other embodiments the working machine may be a rotating telescopic handler, a forklift, a skid-steer loader, a compact track loader, a wheel loader, or a telescopic wheel loader, a tractor, for example. Such working machines may be denoted as off-highway vehicles or as non-road mobile machinery. The working machine 10 includes a machine body 12. The machine body 12 may include, for example, an operator's cab 14 from which an operator can operate the machine 10. The operator cab 14 may be mounted on the body 12 so as to be offset from a center of the body. Although in alternative arrangements, the cab 14 may be substantially central.

The working machine 10 has a ground engaging propulsion arrangement. The ground engaging propulsion arrangement or structure supports the body 12. The ground engaging propulsion structure includes a first, or front, axle A1 and a second, or rear, axle A2, each axle being coupled to a pair of wheels 16, 18. In other embodiments, the ground engaging propulsion structure may include a pair of endless tracks. One or both of the axles A1, A2 may be coupled to a drive arrangement 60 configured to drive movement of the ground engaging propulsion structure (i.e. the axles A1, A2). The drive arrangement 60 causes movement of the working machine 10 over a ground surface. The drive arrangement 60 includes a primer mover 62 and a transmission. The prime mover 62 may be an internal combustion engine, an electric motor, or may be a hybrid comprising both an internal combustion engine, an electric motor.

A working arm 20 is pivotally connected to the body 12. The working arm 20 is connected to the body 12 by a mount 22 proximate a first end, or proximal end, of the working arm 20. The working arm 20 is configured for mounting a first working implement (not shown) at a distal end thereof. The working arm 20 includes a first arm 21 pivotally connected to the body 12, a second arm 23 pivotally connected to the first arm 21, and a third arm 25 pivotally connected to the second arm 23. In alternative arrangements, the working arm 20 may include the first and second arms (i.e. the working arm may include a boom and a dipper arm), may be a telescopic arm having a first section connected to the mount 22 and a second section which is telescopically fitted to the first section. In some arrangements, the working arm may be a mono boom made from a single generally curved structure.

The working arm 20 can be moved with respect to the machine body 12 and the movement is preferably, at least in part, rotational movement about the mount 22. The rotational movement is about a substantially transverse axis of the machine 10. Rotational movement of the working arm 20 with respect to the machine body 12 is, in an embodiment, achieved by use of at least one lifting actuator (not shown) coupled between the arm 20 and the body 12.

The body 12 includes an undercarriage or chassis 24 supported on the ground engaging propulsion arrangement, and a superstructure 26. It will be appreciated that in some arrangements, the mount 22 may be provided on the undercarriage/chassis 24 or the superstructure 26. The working machine 10 includes a counterweight 28 provided on the superstructure 26, the counterweight 28 having a mass for counterbalancing the working arm 20.

The working machine 10 includes first and second chassis implement mounts 30, 32 connected to the undercarriage 24 for operably mounting working implements to the undercarriage 24. In the arrangement shown, the first chassis implement mount 30 mounts a dozer blade arrangement 34 to one end of the undercarriage 24. The dozer blade arrangement 34 may be raised and lowered by hydraulic cylinders 36 using a known arrangement. In the arrangement shown, the second chassis implement mount 32 mounts a stabilizer leg arrangement 38 to an opposite end of the undercarriage 24. The stabilizer leg arrangement 38 may be raised and lowered by hydraulic cylinders 40 using a known arrangement. It will be appreciated that in alternative arrangements, different implements may be mounted to the first and second chassis implement mounts 30, 32, or that one or both of the first and second chassis implement mounts 30, 32 may be omitted.

The superstructure 26 may include the cab 14 and arm 20. The superstructure 26 is rotatable about a rotational axis R (e.g. about a substantially vertical axis) relative to the undercarriage/chassis 24. Put another way, the superstructure 26 may be rotatable relative to the ground engaging propulsion structure. The working machine 10 includes a rotary connector 64 connecting the superstructure 26 to the undercarriage 24 and configured to permit rotation of the superstructure 26 relative to the undercarriage 24 about the rotational axis R. The rotary connector 64 may be a slewing mechanism in the form of a slewing ring. In the present embodiment, the rotary connector 64 permits unrestricted (i.e.) 360° rotation of the superstructure 26 relative to the undercarriage 24. The rotary connector 64 between the superstructure 26 and the undercarriage 24 include a rotary joint arrangement configured to permit electrical signals, fuel and/or hydraulic fluid to be routed between the superstructure 26 and the undercarriage 24 independently of the position of the superstructure 26 relative to the undercarriage 24.

The operator's cab 14 may be rotatably mounted on the superstructure 26. In such arrangements, the superstructure 26 may be rotatable about a first generally upright axis, and the operator's cab 14 may be rotatable about a second generally upright axis. Alternatively, the superstructure 26 and the cab 14 may be rotatable about the same axis.

The working machine 10 includes a fuel tank assembly 42. The fuel tank assembly 42 includes at least one fuel tank 44. The fuel tank 44 defines an internal volume for storing fuel to be supplied to the prime mover 62. It will be appreciated that the fuel tank 44 may be configured for storing hydrogen, metal hydrides, liquid fuel, alcohol, gas, petrol or diesel.

The fuel tank 44 is interposed between the superstructure 26 and the undercarriage 24. Put another way, the fuel tank 44 is at least partially interposed between the undercarriage 24 and the operator cab 14. Positioning the fuel tank 44 between the undercarriage 24 and the superstructure 26 provides a compact packing of the fuel tank 44 on the working machine 10.

It will be appreciated that in some arrangements, the fuel tank assembly 42 may be mounted to an upper region of the undercarriage 24 such that the fuel tank assembly 42 (and so the fuel tank 44) is rotationally fixed to the undercarriage 24. In alternative arrangements, it will be appreciated that the fuel tank assembly 42 may be mounted to a lower region of the superstructure 26 such that the fuel tank assembly 42 (and so the fuel tank 44) is rotatable relative to the undercarriage 24.

The superstructure 26 includes a structural platform 46. The structural platform 46 is mounted on the rotary connector 64. The platform 46 mounts the cab 14. The platform 46 mounts the counterweight 28. The fuel tank 44 is configured and arranged such that it does not project beyond the footprint of the platform 46. This provides a compact packing of the fuel tank 44, which minimizes the impact on operator visibility and minimizes the amount of machine overhang.

Figure 2:
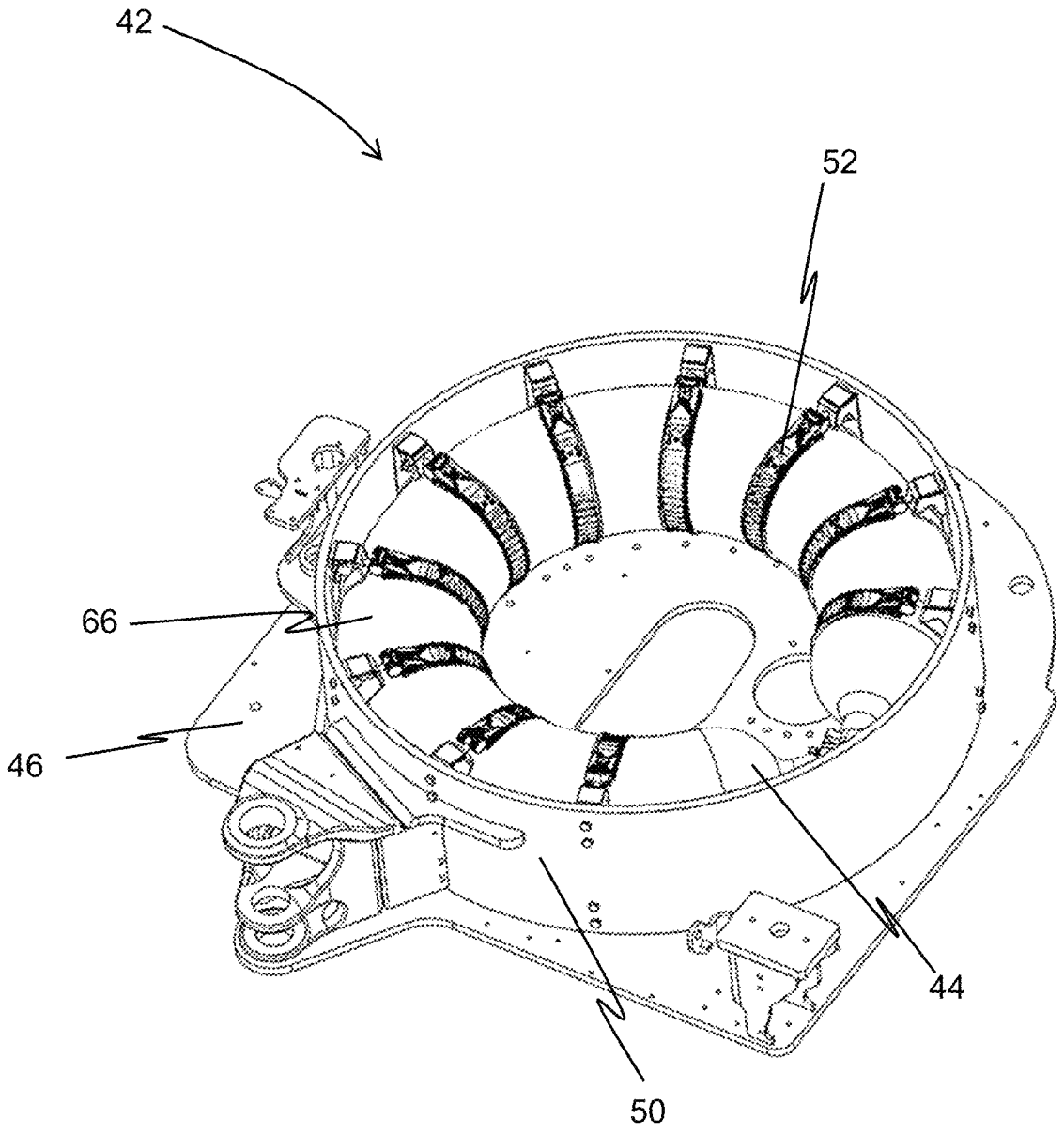
FIG. 2 is an isometric view of a fuel tank assembly of the working machine of FIG. 1.
Figure 3:
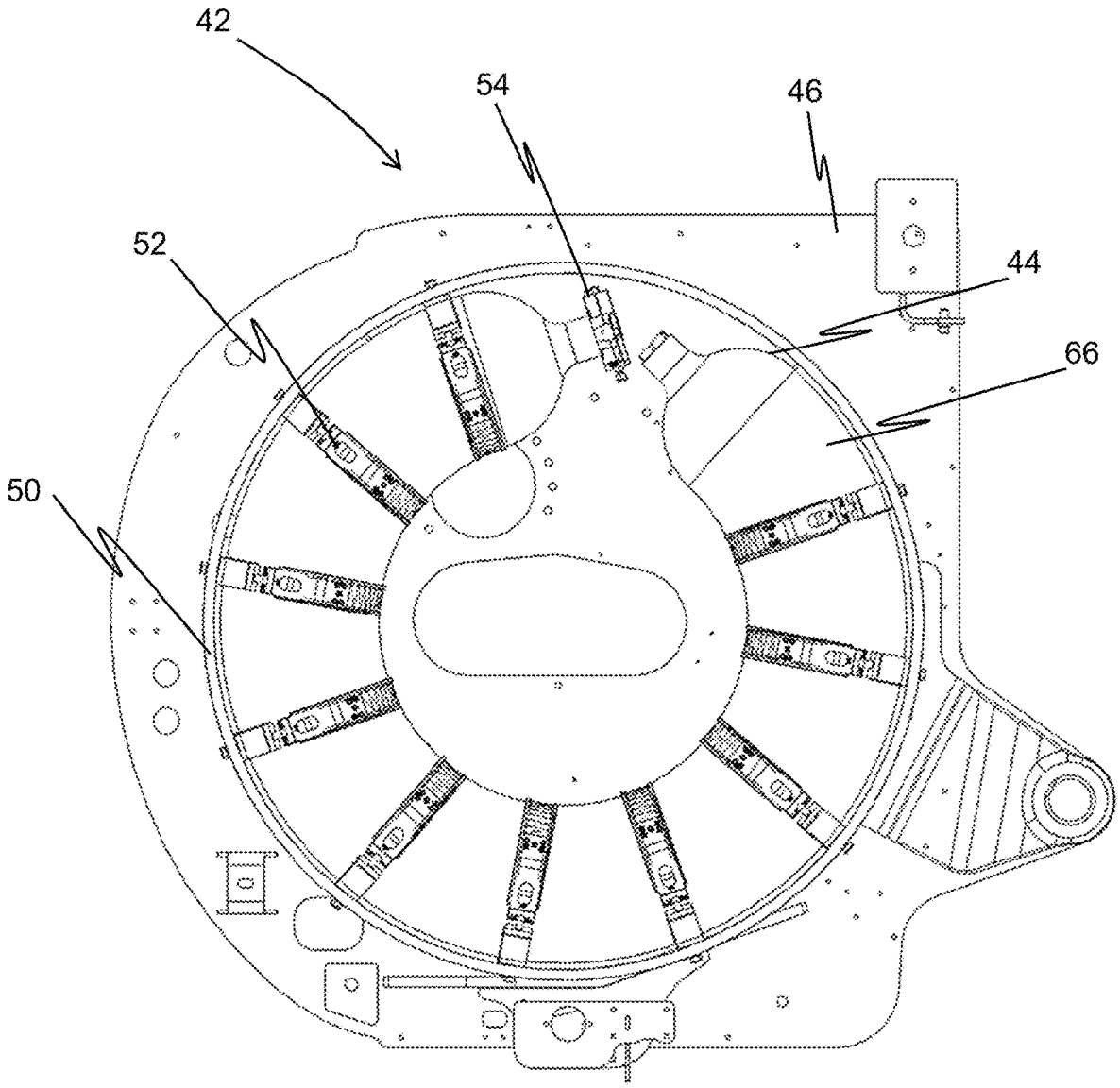
FIG. 3 is a plan view of the fuel tank assembly of FIG. 2.

Referring now to FIGS. 2 and 3, the fuel tank assembly 42 and fuel tank 44 are illustrated in more detail.

The at least one fuel tank 44 is configured or arranged so as to be positioned around the rotational axis R. In this way, the at least one fuel tank 44 defines an opening therethrough, which permits electrical signals, and/or hydraulic fluid to be routed therethrough. Positioning of the fuel tank 44 so as to extend around or surround the rotational axis R works to provide a compact fuel tank 44, without increasing the footprint of the superstructure 26.

In the illustrated arrangement, the fuel tank 44 is substantially non-linear such that the fuel tank 44 at least partially extends around the rotational axis R. Put another way, the fuel tank 44 is configured so as to curve at least partially around the rotational axis R. In alternative arrangements, it will be appreciated that that the fuel tank may be angled so as to at least partially around the rotational axis R. In further alternative arrangements, it will be appreciated that the fuel tank assembly 42 may include a plurality (e.g. two, three, four or more) of fuel tanks 44 that are substantially linear but are arranged so as to be positioned at least partially around the rotational axis R.

Providing a curved fuel tank 44 has been found to provide a more even distribution of pressure within the fuel tank 44, when said fuel tank 44 is loaded with pressurized fuel. Such an arrangement can be particularly advantageous with high pressure fuels such as hydrogen, metal hydrides.

Figure 4:
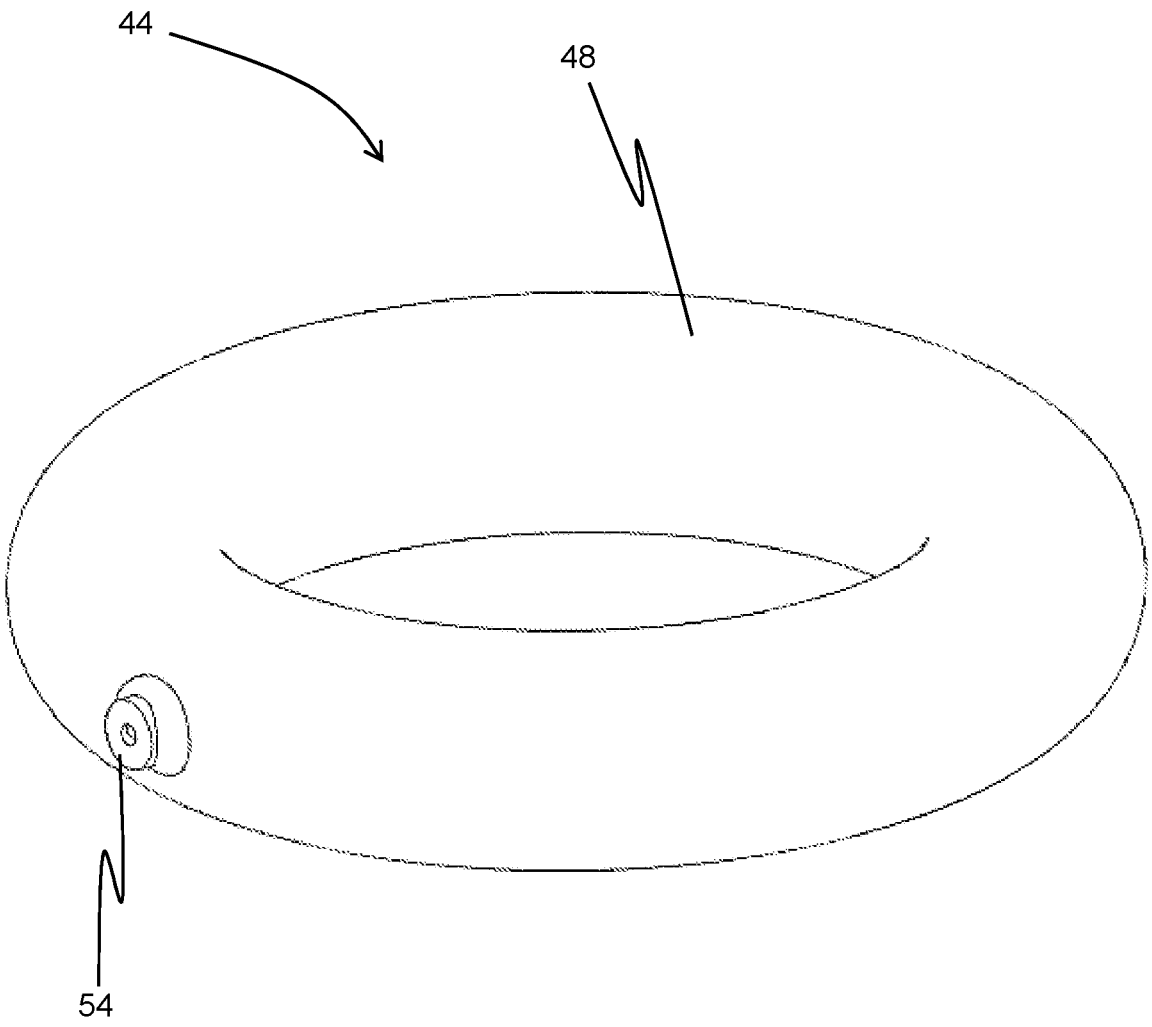
FIG. 4 is an isometric view of a fuel tank according to an embodiment.

The fuel tank 44 may define at least a segment of a circle. This has been found to further improve pressure distribution of the stored fuel. Put another way, the fuel tank may be substantially C-shaped (so as to define a segment of a circle) as is shown in FIGS. 2 and 3, or the fuel tank 44 may be substantially circular as is shown in FIG. 4. In the embodiment of FIG. 4, the fuel tank 44 may be considered to be a toroidal fuel tank. Fuel tanks 44 that at least define a segment of a circle have been found to have increased storage capacity, whilst not projecting out from the footprint of the superstructure 26.

The fuel tank 44 defines a profile in cross-section that is curved (i.e. continuously curved). The curved cross-sectional profile provides a more even distribution of pressure, when the fuel tank 44 is loaded with pressurized fuel. In the arrangement shown, the cross-sectional profile is circular or substantially circular. In alternative arrangements, the cross-sectional profile may be substantially rectangular, may be elliptical, or ma be any other suitable shape.

In the arrangement shown in FIGS. 2 to 4, the fuel tank 44 includes a tank body 48 that is formed in one-piece. Put another way, the tank body 48 is formed as a unitary surface devoid of join/weld lines that might otherwise form weakened regions in the fuel tank 44. Forming the fuel tank body 48 from a single piece of material (i.e. as a unitary surface) enables the fuel tank to store higher pressure fuel. In the arrangement shown, the fuel tank 44 (i.e. the fuel tank body 48) formed via blow molding. Put another way, the fuel tank body 48 is a blow molded metal body. The fuel tank 44 may also be provided with a reinforcing cover or sheath 66. The cover or sheath 66 may extend substantially over an entirety of the fuel tank 44. The cover or sheath 66 may be formed from a fiber reinforced material, e.g. carbon fiber material, although any other suitable material may be used. It will be appreciated that the fuel tank 44 included a port 54 so as to enable fuel to be put into and taken out from the fuel tank 44.

The fuel tank 44 is positioned within a reinforcing bracket 50. Put another way, the fuel tank assembly 42 includes reinforcing bracket 50 The reinforcing bracket 50 is configured to conform to an outer surface of the curved fuel tank 44. The bracket 50 works against the pressure of the fuel stored within the fuel tank 44 that would otherwise deform the fuel tank 44 so as to straighten it. The reinforcing bracket 50 is substantially circular in the arrangement shown. Put another way, the reinforcing bracket is provided as a reinforcing ring 50. The reinforcing bracket is attached, e.g. welded, to the superstructure platform 46. The fuel tank 44 may be secured to the reinforcing bracket 50. The fuel tank 44 may be secured to the reinforcing bracket 50 via one or more attachment members 52, e.g. straps and/or clamps.

Although the teachings have been described above with reference to one or more preferred embodiments, it will be appreciated that various changes or modifications may be made without departing from the scope as defined in the appended claims.

The invention claimed is:

1. A working machine comprising:

a ground engaging structure provided in the form of front and rear wheels or a pair of endless tracks;

an undercarriage supported on the ground engaging structure;

a drive arrangement configured to provide motive power to the ground engaging structure to propel the working machine, the drive arrangement comprising a prime mover;

a superstructure connected to the undercarriage;

a rotary connector connecting the superstructure to the undercarriage and configured to permit rotation of the superstructure relative to the undercarriage about a rotational axis;

a working arm connected to the superstructure; and a hydrogen fuel tank assembly comprising at least one fuel tank defining an internal volume for storing fuel to be supplied to the prime mover, wherein the at least one fuel tank comprises an elongate cylinder or torus having a principal axis that encircles the rotational axis.

2. The working machine according to claim 1, wherein the superstructure comprises a structural platform mounted on the rotary connector, and wherein the at least one fuel tank does not project beyond the footprint of the platform.

3. The working machine according to claim 1, wherein the at least one fuel tank is interposed between the superstructure and the undercarriage.

4. The working machine according to claim 1, wherein the at least one fuel tank is non-linear such that the at least one fuel tank at least partially extends around the rotational axis.

5. The working machine according to claim 4, wherein the at least one fuel tank is curved so as to at least partially curve around the rotational axis.

6. The working machine according to claim 1, wherein the at least one fuel tank comprises a tank body formed in one-piece.

7. The working machine according to claim 6, wherein the fuel tank body is a blow molded metal tank body.

8. The working machine according to claim 1, wherein the at least one fuel tank comprises a reinforcing cover.

9. The working machine according to claim 8, wherein the reinforcing over comprises a fiber reinforced material.

10. The working machine according to claim 1, wherein the curved fuel tank is positioned within a reinforcing bracket of the fuel tank assembly that is configured to conform to an outer surface of the curved fuel tank.

11. The working machine according to claim 10, wherein the reinforcing bracket is substantially circular.

12. The working machine according to claim 11, wherein the curved fuel tank is secured to the reinforcing bracket via one or more attachment members.

13. The working machine according to claim 1, wherein the rotary connector between the superstructure and the undercarriage comprises a rotary joint arrangement configured to permit electrical signals, fuel and/or hydraulic fluid to be routed between the superstructure and the undercarriage independently of the position of the superstructure relative to the undercarriage and the fuel tank assembly defines an opening therethrough to permit electrical signals, and/or hydraulic fluid to be routed therethrough.

14. The working machine according to claim 1, wherein the fuel tank assembly is configured and arranged to surround the rotational axis.

15. The working machine according to claim 1, comprising an operator's cab rotatably mounted on the superstructure, wherein the at least one fuel tank is at least partially interposed between the undercarriage and the operator cab.

16. The working machine according to claim 1, wherein the working machine is an excavator or compact tail swing excavator or a zero tail swing excavator.

* * * * *